US006994576B2

(12) United States Patent
Tanaka et al.

(10) Patent No.: US 6,994,576 B2
(45) Date of Patent: Feb. 7, 2006

(54) POWER SUPPLY UNIT FOR ELECTRONIC DEVICES

(75) Inventors: Toshihiro Tanaka, Miyagi-ken (JP); Katsumi Myochin, Kanagawa-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/979,827

(22) Filed: Nov. 1, 2004

(65) Prior Publication Data

US 2005/0062478 A1 Mar. 24, 2005

Related U.S. Application Data

(63) Continuation of application No. 10/700,742, filed on Nov. 4, 2003, now Pat. No. 6,869,299.

(30) Foreign Application Priority Data

Nov. 5, 2002 (JP) ..... 2002-321186

(51) Int. Cl.
*H01R 29/00* (2006.01)

(52) U.S. Cl. ..... 439/188; 439/500; 200/51.1

(58) Field of Classification Search ..... 439/188, 439/500, 929; 200/51.1; 320/110–115
See application file for complete search history.

(56) References Cited

U.S. PATENT DOCUMENTS

| | | | |
|---|---|---|---|
| 4,911,650 | A | 3/1990 | Garcia Ramos |
| 4,965,462 | A | 10/1990 | Crawford |
| 5,007,851 | A | 4/1991 | Matsumoto |
| 5,122,721 | A | 6/1992 | Okada et al. |
| 5,140,138 | A | 8/1992 | Tanaka |
| 5,220,520 | A | 6/1993 | Kessoku |
| 5,306,956 | A | 4/1994 | Ikeda et al. |
| 5,402,008 | A | 3/1995 | St. John |
| 5,421,189 | A | 6/1995 | Dussault |
| 5,470,255 | A | 11/1995 | McCleerey et al. |
| 5,473,242 | A | 12/1995 | McKenna |
| 5,518,424 | A | 5/1996 | Douty et al. |
| 5,525,888 | A | 6/1996 | Toya |
| 5,578,391 | A | 11/1996 | Meyers et al. |
| 5,684,673 | A | 11/1997 | Shibasaki et al. |
| 5,686,810 | A | 11/1997 | Yasui |
| 5,738,954 | A | 4/1998 | Latella et al. |
| 5,739,596 | A | 4/1998 | Takizawa et al. |
| 5,746,626 | A | 5/1998 | Kwiat et al. |

(Continued)

FOREIGN PATENT DOCUMENTS

| | | |
|---|---|---|
| EP | 0 392 857 | 10/1990 |

(Continued)

*Primary Examiner*—Ross Gushi
(74) *Attorney, Agent, or Firm*—Brinks Hofer Gilson & Lione

(57) ABSTRACT

A power supply unit for electronic devices has an insulating battery pack holder with a hollow portion to accommodate a battery pack detachably; a plurality of connector contacts and a switch contact formed of conductive metal and disposed inside the battery pack holder, part of each connector contact protruding toward the hollow portion, the switch contact capable of detaching from or attaching to a predetermined one of the connector contacts with a moving contact portion. When the battery pack is accommodated in the hollow portion, its electrode terminals elastically touch corresponding connector contacts to be conductively connected to a driver circuit. In removal of the battery pack from the hollow portion, when the predetermined connector contact protrudes into the hollow portion by a predetermined distance according to a reduction in urging force of the electrode terminal, the predetermined connector contact touches the switch contact to output a detection signal.

14 Claims, 7 Drawing Sheets

U.S. PATENT DOCUMENTS 5,768,098 A 6/1998 Murayama
5,863,218 A 1/1999 Quat et al.
5,865,643 A * 2/1999 Suzuki ..... 439/500
5,867,798 A 2/1999 Inukai et al.
5,885,090 A 3/1999 Comstock et al.
5,900,719 A 5/1999 Limura
5,904,597 A 5/1999 Doi et al.
5,907,197 A 5/1999 Faulk
5,931,683 A 8/1999 Pinel
6,014,010 A 1/2000 Yao
6,077,130 A 6/2000 Hughes et al.
6,113,440 A 9/2000 Fijten et al.
6,135,809 A 10/2000 Asakawa
6,268,709 B1 7/2001 Lee et al.
6,269,500 B1 8/2001 Saringer
6,274,266 B1 8/2001 Wang
6,302,727 B1 * 10/2001 Fedorjaka ..... 439/500
6,326,766 B1 12/2001 Small
6,337,558 B1 1/2002 Yuen et al.
6,358,074 B2 3/2002 Bricaud et al.
6,361,359 B1 * 3/2002 Du et al. ..... 439/500
6,409,529 B1 6/2002 Lui et al.
6,435,887 B2 8/2002 Koitsalu
6,439,906 B1 8/2002 Gray et al.
6,461,764 B1 10/2002 Nakamura
6,464,512 B2 10/2002 Morita
6,478,595 B2 11/2002 Nishioka
6,485,319 B2 11/2002 Bricaud et al.
6,515,450 B1 2/2003 Kaiho et al.
6,563,713 B2 * 5/2003 Yang ..... 361/752
6,568,956 B1 5/2003 Holmberg
6,583,600 B2 6/2003 Haga et al.
6,597,572 B2 7/2003 Nishikawa et al.
6,602,635 B1 8/2003 Laitinen et al.
6,605,923 B1 8/2003 Kellogg
6,612,856 B1 9/2003 McCormack
6,623,316 B1 9/2003 Wu
6,646,414 B2 11/2003 Small
6,652,302 B1 11/2003 Yeh
6,661,196 B1 12/2003 Zeng et al.
D486,448 S 2/2004 Watanabe et al.
6,695,628 B2 2/2004 Yeh
6,710,576 B1 3/2004 Kaufman et al.

FOREIGN PATENT DOCUMENTS

GB 2 300 998 11/1996

* cited by examiner

POWER SUPPLY UNIT FOR ELECTRONIC DEVICES

This application is a Continuation of pending U.S. patent application Ser. No. 10/700,742, filed Nov. 4, 2003 now U.S. Pat. No. 6,869,299, which claims the benefit of priority to Japanese Patent Application No. 2002-321186, both of which are herein incorporated by reference.

BACKGROUND OF THE INVENTION

1. Field of the Invention

The present invention relates to a built-in power supply unit for electronic devices that a battery pack is fitted to and, more particularly, to a power supply unit suitable for electronic devices such as personal digital assistants that switch to a backup power source when a battery pack is removed.

2. Description of the Related Art

Personal digital assistants such as cell-phones generally have a power supply unit that a battery pack is fitted to. The power supply unit has an insulating battery pack holder with a hollow portion to accommodate a battery pack detachably. A plurality of connector contacts formed of conductive metal are disposed inside the battery pack holder. Part of each connector contact protrudes into the hollow portion. These connector contacts are disposed in the positions corresponding to electrode terminals of the battery pack. When the battery pack is fitted into the hollow portion, the connector contacts are deformed elastically and pressed against the corresponding electrode terminals of the battery pack. The electrode terminals of the battery pack are thus conductively connected to a driver circuit through the connector contacts and power is supplied to the driver circuit.

Some of these types of personal digital assistants have a built-in backup power source in order to be usable even if the battery pack is removed. The backup power source is charged from the fitted battery pack and it discharges according to a change of an electrical signal caused by removal of the battery pack from the power supply unit.

However, the personal digital assistants that switch to the backup power source according to a change of an electrical signal caused by removal of the battery pack as described above have a problem. The problem is that the transmitting and receiving function is lost when the battery pack is replaced because power is not supplied from either the battery pack or the backup power source for a moment.

To solve this problem, a switch unit that can detect that the battery pack is almost completely removed and that can switch to the backup power source before the battery pack is removed completely is being studied. However, it is difficult, because of a restricted space, to add such a switch unit to the power supply unit for the electronic devices that require miniaturization. In addition, it increases the cost.

SUMMARY OF THE INVENTION

It is an object of the present invention to provide a power supply unit for electronic devices that has a simple structure, that can detect incomplete fitting of a battery pack, and that does not hinder miniaturization of the electronic devices.

In order to attain the above-described object, according to the present invention, a power supply unit accommodates a battery pack with a plurality of electrode terminals and supplies power to a driver circuit of an electronic device. The power supply unit has an insulating battery pack holder with a hollow portion to accommodate the battery pack detachably; a plurality of connector contacts formed of conductive metal and disposed inside the battery pack holder, part of each connector contact protruding toward the hollow portion; and a switch contact formed of conductive metal and disposed inside the battery pack holder, the switch contact capable of detaching from or attaching to a predetermined one of the connector contacts. When the battery pack is accommodated in the hollow portion, the plurality of electrode terminals elastically come into contact with corresponding connector contacts to be conductively connected to the driver circuit, and the predetermined connector contact is elastically deformed by the corresponding electrode terminal to separate from the switch contact. When the predetermined connector contact protrudes into the hollow portion by a predetermined distance according to a reduction in urging force of the electrode terminal, the predetermined connector contact comes into contact with the switch contact to output a detection signal.

In the removal of the battery pack from the battery pack holder, when the predetermined connector contact protrudes into the hollow portion by a predetermined distance according to a reduction in urging force of the electrode terminal of the battery pack, the predetermined connector contact comes into contact with the switch contact to output a detection signal. The power supply unit for electronic devices configured as above thus can detect incomplete fitting of the battery pack, namely, that the battery pack is almost completely removed. In addition, the connector contact for conductively connecting the electrode terminal of the battery pack to the driver circuit of the electronic devices is used as a moving contact that touches and separates from the switch contact. Therefore, the power supply unit has a simple and compact structure compared to when a detector switch unit is provided separately.

For example, if the predetermined connector contact keeps contact with the corresponding electrode terminal when the predetermined connector contact touches the switch contact, and if power supply from the backup power source to the driver circuit starts according to the detection signal, when the battery pack is removed from the battery pack holder, power supply from the backup power source can start before the power supply from the battery pack is cut off, and therefore the driver circuit is continuously supplied with power.

Additionally, concerning the above power supply unit, if a connector that functions as a detector switch is configured by accommodating the predetermined connector contact and the switch contact in an insulating housing with an opening and making part of the predetermined connector contact retractably protrude out of the housing through the opening, and if the connector is built into the battery pack holder, it is made possible to improve usability and the ease in building the power supply unit because the switch contact and the connector contact are unitized. In this case, the connector may be configured by disposing the switch contact and a plurality of connector contacts side by side in one housing. For example, adopting the connector that unitizes the required number of connector contacts and the switch contact makes it possible to improve to a large extent the ease in building the power supply unit.

DESCRIPTION OF THE PREFERRED EMBODIMENTS

Figure 1:
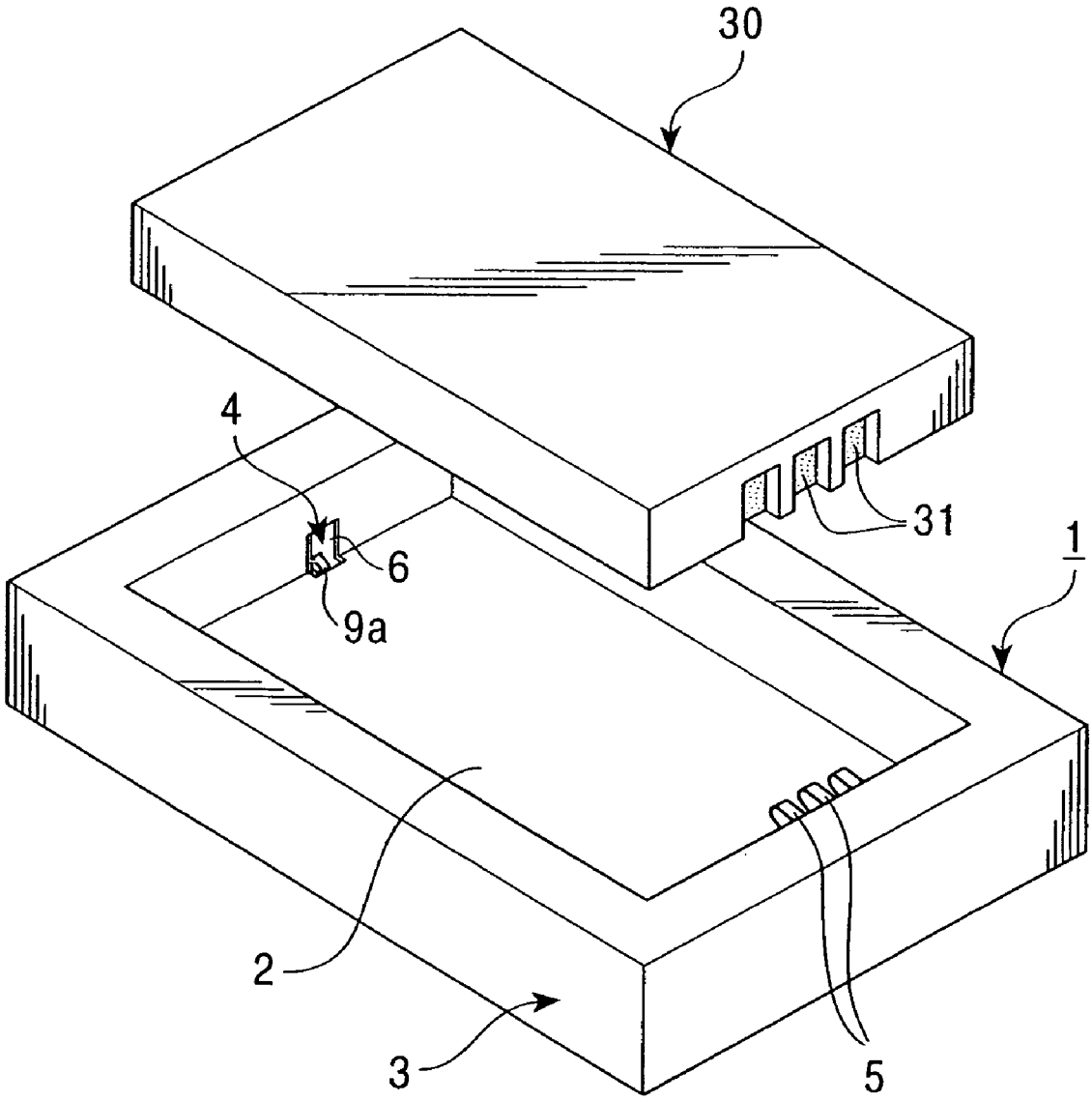
FIG. 1 is a perspective view of a power supply unit according to an embodiment of the present invention.
Figure 2:
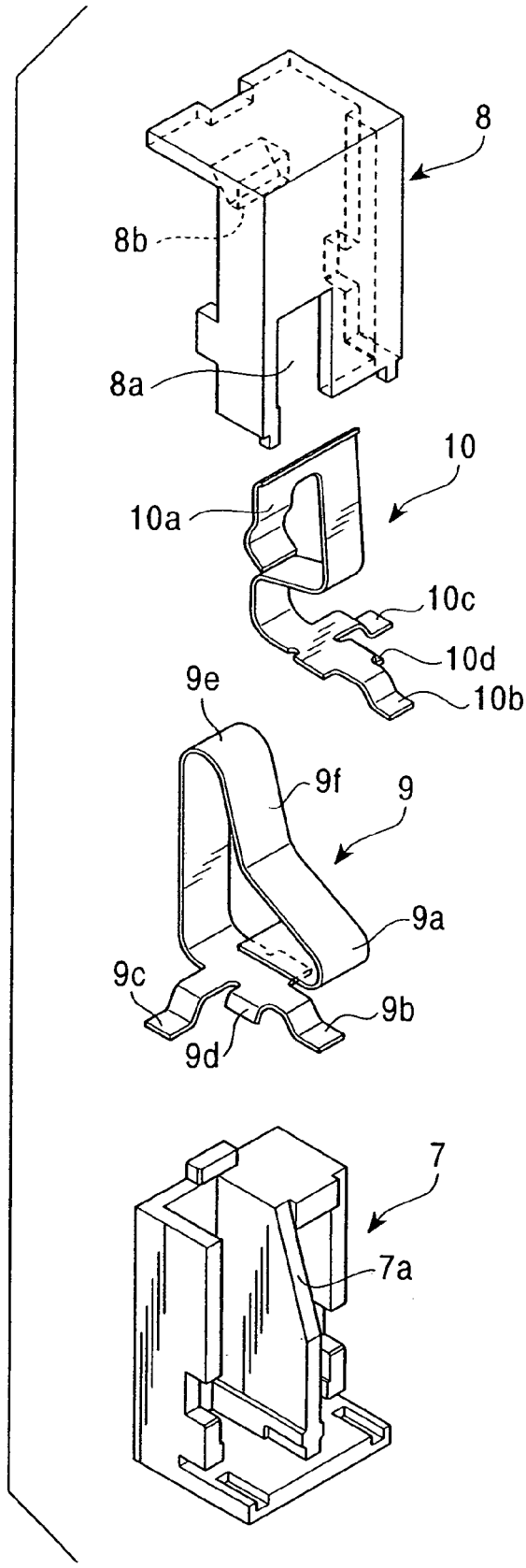
FIG. 2 is an exploded perspective view of a switch-connector shown in FIG. 1.
Figure 3:
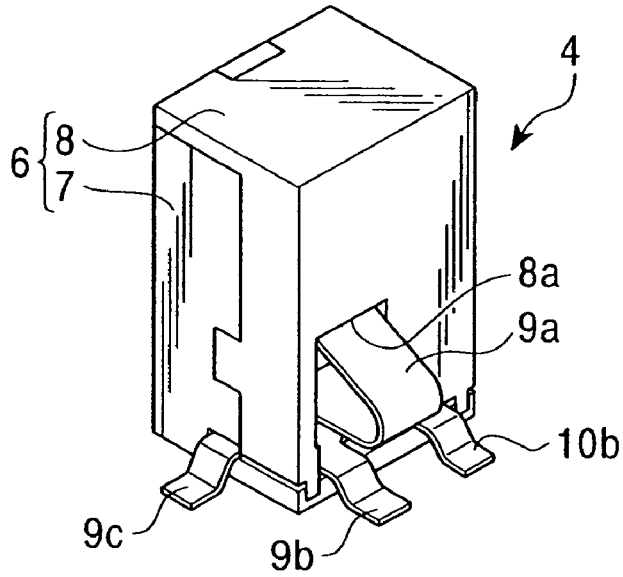
FIG. 3 is an external view of the switch-connector.
Figure 4:
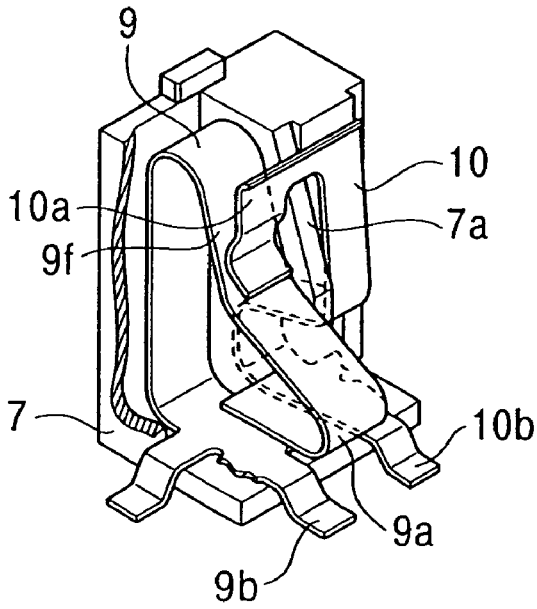
FIG. 4 is an illustration of the internal structure of the switch-connector.
Figure 5A:
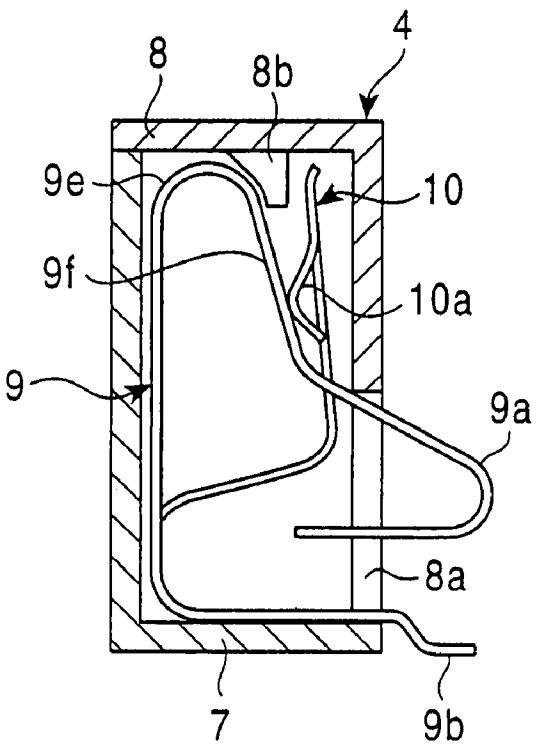
FIGS. 5A, 5B, and 5C are illustrations of switching action of the switch-connector.
Figure 5B:
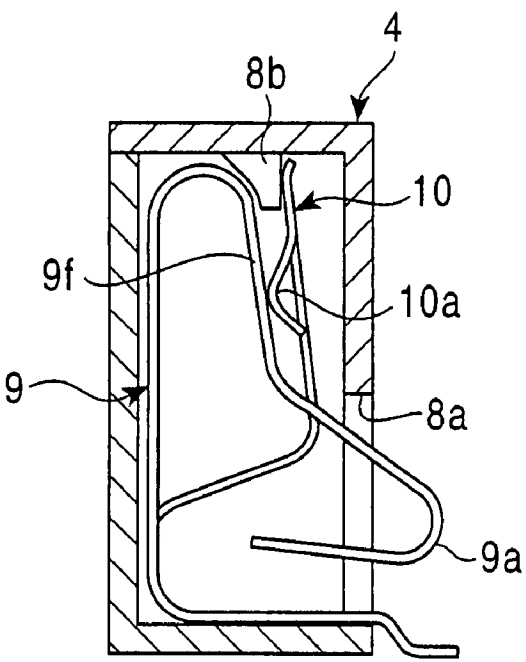
Figure 5C:
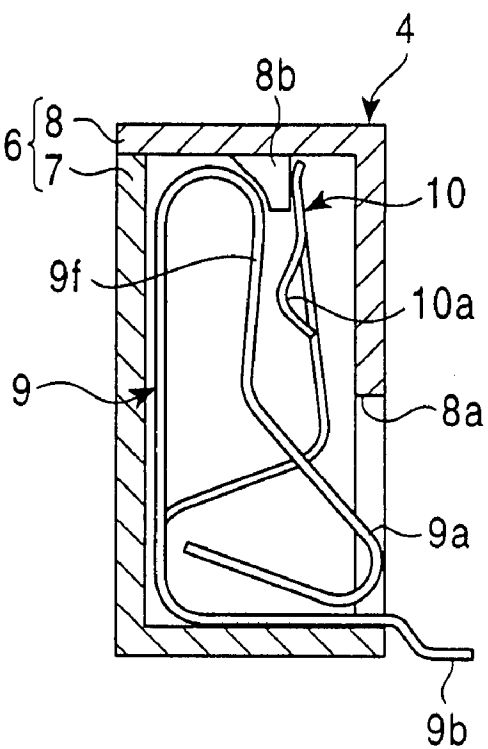

The preferred embodiments of the present invention will now be described with reference to the drawings. FIG. 1 is a perspective view of a power supply unit according to an embodiment of the present invention; FIG. 2 is an exploded perspective view of a switch-connector shown in FIG. 1; FIG. 3 is an external view of the switch-connector; FIG. 4 is an illustration of the internal structure of the switch-connector; FIGS. 5A, 5B, and 5C are illustrations of switching action of the switch-connector; and FIGS. 6A, 6B, 6C, and 6D are illustrations of removal of the battery pack shown in FIG. 1 from the battery pack holder.

The power supply unit 1 shown in FIG. 1 is built in electronic devices such as personal digital assistants and for supplying power to a driver circuit of the electronic device. A battery pack 30 is fitted to the power supply unit 1. The power supply unit 1 includes a battery pack holder 3, a switch-connector 4 that functions as a connector and a switch, and three connector contacts 5. The battery pack holder 3 has a hollow portion 2 to accommodate the battery pack 30 detachably. The switch-connector 4 is built in the battery pack holder 3, facing the hollow portion 2. The three connector contacts 5 are disposed opposite the switch-connector 4 and the free end of each connector contact 5 protrudes toward the hollow portion 2 from the wall surface of the battery pack holder 3. The battery pack 30 has a total of four electrode terminals 31 on its surface at one end and the other end. The switch-connector 4 functions as a switch to detect whether the battery pack 30 is properly fitted to the battery pack holder 3 or not. The electrode terminals 31 of the battery pack 30 are conductively connected to the driver circuit through part of the switch-connector 4 and the connector contacts 5.

The battery pack holder 3 is formed of an insulating material. Its frame-shaped portion surrounding the hollow portion 2 has internal spaces for accommodating the switch-connector 4 and the connector contacts 5. The battery pack holder 3 has a built-in circuit board (not shown), on which the switch-connector 4 and the connector contacts 5 are mounted.

As shown in FIGS. 2 to 5C, the switch-connector 4 is composed of mainly a housing 6, a switch-connector contact 9, and a switch contact 10. The housing 6 is a box composed of an insulating case 7 and an insulating cover 8. The switch-connector contact 9 is formed of conductive metal and it has a connector contact portion 9*a* which is a free end retractably protruding from the housing 6. The switch contact 10 is formed of conductive metal and it is so held in the housing 6 that the switch contact 10 and the switch-connector contact 9 can touch and separate.

The case 7 has a partition wall 7*a* that separates a space for disposing the switch-connector contact 9 and a space for disposing the switch contact 10 to prevent short-circuiting. The cover 8 has an opening 8*a* from which the connector contact portion 9*a* protrudes and a projection 8*b* for restricting movement of the switch-connector contact 9 and the switch contact 10. The switch-connector contact 9 has, at its base, external connecting terminals 9*b* and 9*c* which protrude from the case 7 and a positioning pin 9*d* which is pressed into the bottom of the case 7. The switch-connector contact 9 has a moving contact portion 9*f* between the connector contact portion 9*a* and a U-shaped top portion 9*e*. The top portion 9*e* is restricted from moving in the housing 6 by the projection 8*b* of the cover 8. The switch contact 10 has, at its base, external connecting terminals 10*b* and 10*c* which protrude from the case 7 and a positioning pin 10*d* which is pressed into the bottom of the case 7. The switch contact 10 has, at its free end, an L-shaped extension 10*a* extending across the partition wall 7*a* to the switch-connector contact 9. The end of the extension 10*a* and the moving contact portion 9*f* of the switch-connector contact 9 can touch and separate.

The switch-connector 4 functions as a normally closed type of switch. In the initial condition shown in FIG. 5A, the connector contact portion 9*a* of the switch-connector contact 9 protrudes from the opening 8*a* to a large extent, and the moving contact portion 9*f* of the switch-connector contact 9 is elastically pressed against the end of the extension 10*a* of the switch contact 10. When the connector contact portion 9*a* is pressed into the housing 6 to a large extent, as shown in FIG. 5C, the moving contact portion 9*f* separates from the extension 10*a* according to elastic deformation of the switch-connector contact 9. As for the switch contact 10, the upper part of the extension 10*a* is elastically pressed against the projection 8*b* of the cover 8 and restricted from moving. FIG. 5B shows the moving contact portion 9*f* and the extension 10*a* that are on the point of touching/separating. At this moment, the extent to which the connector contact portion 9*a* protrudes from the opening 8*a* is nearly half of that in the initial condition. Since the switch-connector contact 9 and the switch contact 10 can thus touch and separate, the switch-connector 4 can function as a detector switch. When the switch-connector contact 9 and the switch contact 10 touch, a detection signal is output from the external connecting terminal 10*b* (or 10*c*).

Each connector contact 5 is formed of conductive metal and it is similar to the switch-connector contact 9 in shape. The connector contact portion 9*a* of the switch-connector contact 9 protrudes in the lower part of the hollow portion 2. But on the other hand, the free ends of the connector contacts 5, which touch the electrode terminals 31, protrude in the upper part of the hollow portion 2. This is so that the connector contacts 5 can separate from the electrode terminals later than the switch-connector contact 9 when the battery pack 30 is removed from the battery pack holder 3. This makes it easy to keep contact between three electrode terminals 31 and the connector contacts 5 when the other electrode terminal 31 separates from the switch-connector contact 9.

The switch-connector contact 9 and the connector contacts 5 are disposed in the positions corresponding to the electrode terminals 31 of the battery pack 30. When the battery pack 30 is fitted in the hollow portion 2, the electrode terminals 31 are pressed against the free ends of the switch-connector contact 9 and the connector contacts 5. The switch-connector contact 9 and the connector contacts 5 are deformed elastically and pressed against the corresponding electrode terminals 31 with sufficient urging force. The external connecting terminal 9*b* (or 9*c*) of the switch-connector contact 9 and an external connecting terminal (not shown) of each connector contact 5 are soldered to the circuit board and connected to the driver circuit. By fitting the battery pack 30 to the hollow portion 2 properly, the electrode terminals 31 are conductively connected with the driver circuit and power supply from the battery pack 30 is made possible.

The external connecting terminal 10*b* (or 10*c*) of the switch contact 10 is soldered to the circuit board and connected to a backup power source (not shown). The backup power source discharges as needed to enable power supply to the driver circuit. When the switch-connector 4 is switched off, the backup power source does not operate. When the switch-connector 4 is switched on, the backup power source supplies power to the driver circuit.

As in this embodiment, providing the switch-connector contact 9 and the switch contact 10 with a pair of external connecting terminals each and soldering either of the terminals to the circuit board as a dummy terminal which does not function electrically are preferable because they increase degree of freedom of wiring pattern and mechanical strength.

The operation of the above power supply unit 1 will now be described. When the battery pack 30 is not fitted in the hollow portion 2 of the battery pack holder 3, as shown in FIG. 1, the free ends of the switch-connector contact 9 and the connector contacts 5 protrude toward the hollow portion 2 to a large extent. At this time, since the switch-connector contact 9 and the switch contact 10 touch in the housing 6 as shown in FIG. 5A, the switch-connector 4 is switched on. Therefore, if the backup power source is charged, power is supplied from the backup power source to the driver circuit.

Figure 6A:
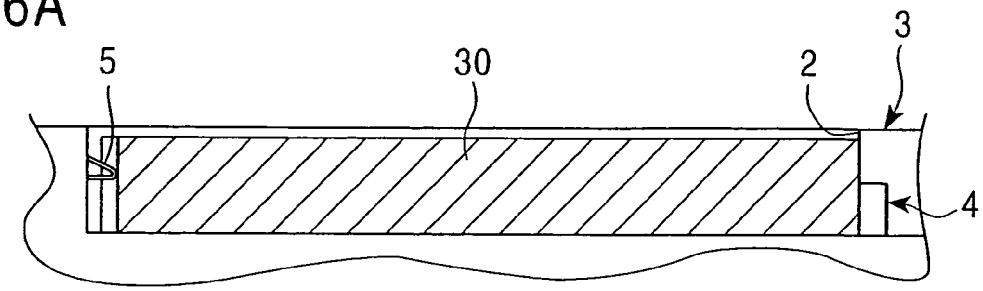
FIGS. 6A, 6B, 6C, and 6D are illustrations of removal of the battery pack shown in FIG. 1 from the battery pack holder.

Normally the battery pack 30 is fitted into the hollow portion 2. Therefore, as shown in FIG. 6A, the switch-connector contact 9 and the connector contacts 5 are pressed into the battery pack holder 3 by the corresponding electrode terminals 31. In this condition, each electrode terminal 31 is conductively connected to the driver circuit through the switch-connector contact 9 and the connector contacts 5, and therefore power is supplied to the driver circuit from the battery pack 30. On the other hand, the switch-connector contact 9 and the switch contact 10 do not touch in the housing 6 as shown in FIG. 5C, that is to say the switch-connector 4 is switched off, and therefore power is not supplied from the backup power source.

Figure 6B:
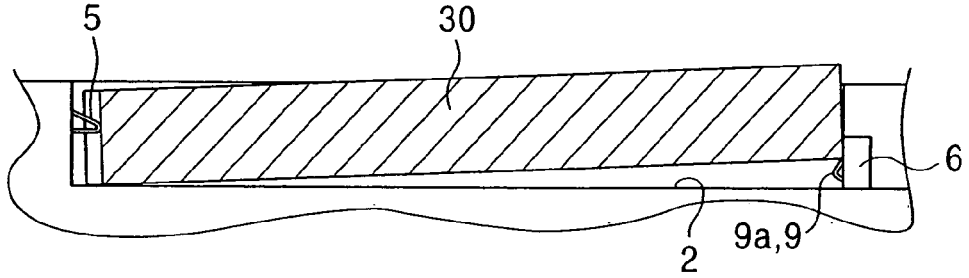
Figure 6C:
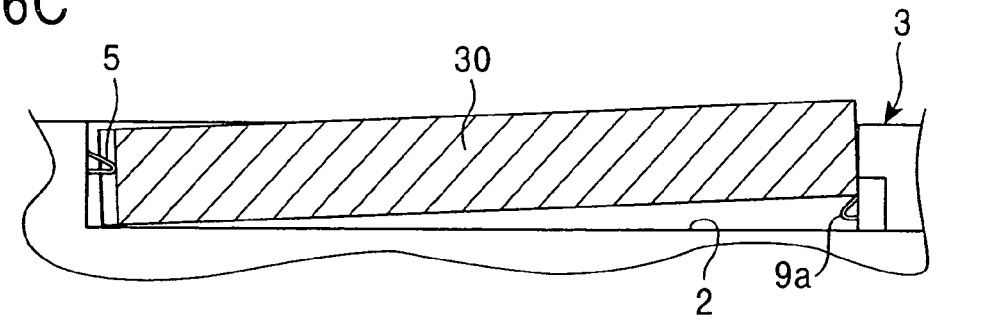
Figure 6D:
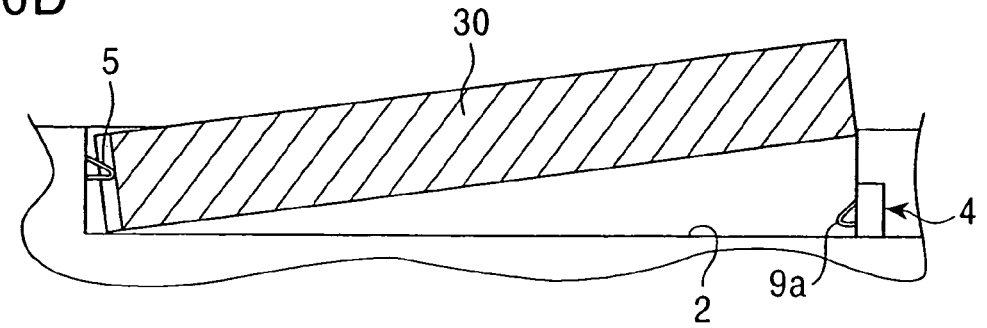

When the run-down battery pack 30 is removed from the battery pack holder 3, the battery pack 30 is tilted slowly and pulled out of the hollow portion 2 as shown in FIGS. 6B to 6D. In this case, as described above, the switch-connector contact 9 separates from the electrode terminal 31 earlier than the connector contacts 5. FIG. 6B shows the connector contact portion 9*a* of the switch-connector contact 9 protruding into the hollow portion 2 by a predetermined distance according to a reduction in urging force of the electrode terminal 31. At this time, in the housing 6, the moving contact portion 9*f* of the switch-connector contact 9 comes into contact with the extension 10*a* of the switch contact 10 as shown in FIG. 5B, and therefore the switch-connector 4 is switched from off to on. Power supply from the backup power source to the driver circuit thus starts. At this time, the connector contact portion 9*a* and the electrode terminal 31 are still kept in contact, and therefore power supply from the battery pack 30 is not cut off. When the electrode terminal 31 separates from the connector contact portion 9*a* as shown in FIG. 6C, power supply from the battery pack 30 is cut off. Then, the battery pack 30 is tilted to a large extent and pulled out of the hollow portion 2 as shown in FIG. 6D. A new battery pack is fitted in the hollow portion 2 in the reverse procedure. When its electrode terminal comes into contact with the connector contact portion 9*a*, power supply from the battery pack starts. When the connector contact portion 9*a* is pressed into the battery pack holder 3 to an extent more than that as shown in FIG. 6B, power supply from the backup power source is cut off.

As described above, according to this embodiment, when the battery pack 30 is removed from the battery pack holder 3, power supply from the backup power source can start before the power supply from the battery pack 30 is cut off, and therefore the driver circuit is continuously supplied with power. A personal digital assistant with the power supply unit 1 does not lose the transmitting and receiving function when the battery pack 30 is replaced, and therefore it has improved usability. In addition, the switch-connector contact 9 of the switch-connector 4 has the function as a moving contact of a switch that detects incomplete fitting of the battery pack 30 as well as the function as a connector conductively connected to the electrode terminal 31 of the battery pack 30. Therefore, the power supply unit 1 has a simple and compact structure compared to when a detector switch unit is provided separately. Besides, since the switch-connector 4 is unitized, the power supply unit 1 is readily built.

Although a single switch-connector 4 is provided in the power supply unit 1 according to this embodiment, two switch-connectors 4 may be disposed in the walls of the battery pack holder 3 which are opposite to each other.

Figure 7:
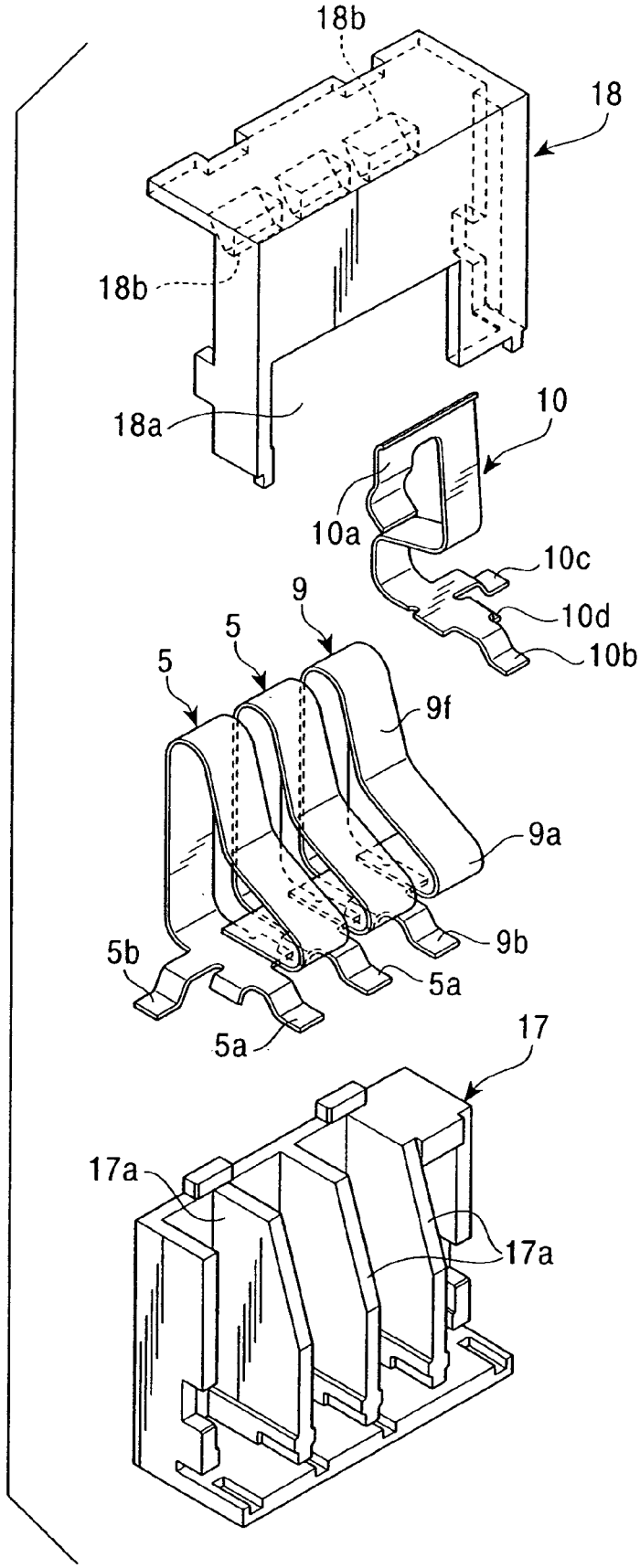
FIG. 7 is an exploded perspective view of a switch-connector according to another embodiment of the present invention.
Figure 8:
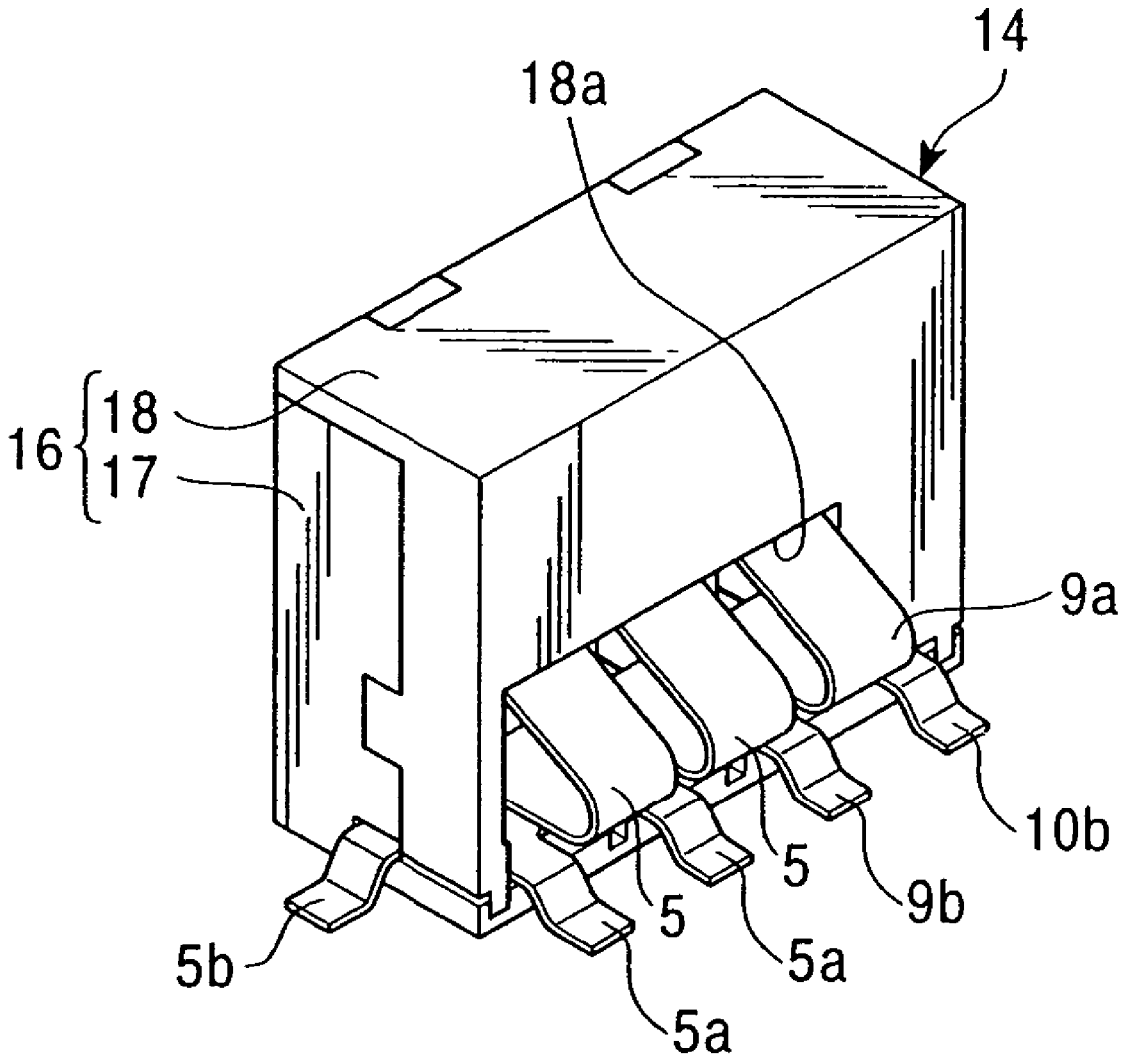
FIG. 8 is an external view of the switch-connector shown in FIG. 7.

As shown in FIGS. 7 and 8, adopting a switch-connector 14 that unitizes not only the switch-connector contact 9 and the switch contact 10 but also the required number of connector contacts 5 makes it possible to improve further the ease in building the power supply unit 1. In this case, an insulating housing 16 is composed of a case 17 and a cover 18. The case 17, in which the connector contacts 5, the switch-connector contact 9, and the switch contact 10 are disposed side by side, has a plurality of partition walls 17*a* for preventing short-circuiting. The cover 18 has, on the top surface of its inside, a plurality of projections 18*b* for restricting movement of the connector contacts 5, the switch-connector contact 9, and the switch contact 10. In FIGS. 7 and 8, the connector contacts 5 and the switch-connector contact 9 are basically the same in shape. Each connector contact 5 has external connecting terminals 5*a* and 5*b*. The connector contact portion 9*a* and the free ends of the connector contacts 5 protrude from an opening 18*a* toward the hollow portion 2.

The present invention is embodied as described above, and it has the following advantages.

In the removal of the battery pack from the battery pack holder, when the predetermined connector contact protrudes into the hollow portion by a predetermined distance according to a reduction in urging force of the electrode terminal of the battery pack, the predetermined connector contact comes into contact with the switch contact to output a detection signal. Therefore, it is possible to detect incomplete fitting of the battery pack, namely, that the battery pack is almost completely removed. Therefore, if the backup power source is operated according to the detection signal, when the battery pack is removed from the battery pack holder, power supply from the backup power source can start before the power supply from the battery pack is cut off, and usability of electronic devices such as personal digital assistants can be improved. In addition, the connector contact for conductively connecting the electrode terminal of the battery pack to the driver circuit of the electronic device is used as a moving contact that touches and separates from the switch contact. Therefore, the power supply unit has a simple and compact structure compared to when a detector switch unit is provided separately.

What is claimed is:

1. A power supply unit comprising:

a holder with a hollow portion;

a plurality of resilient connector contacts disposed inside the holder, part of each connector contact protruding toward the hollow portion, at least one of the connector contacts being a switch connector contact; and a resilient switch contact disposed inside the holder, the resilient switch contact moving in coordination with the switch connector contact such that the switch connector contact and the switch contact are in contact when the switch connector contact protrudes into the hollow portion by at least a predetermined distance and are otherwise disengaged from each other.

2. A power supply unit according to claim 1, further comprising a connector that functions as a detector switch configured by accommodating the switch connector contact and the switch contact in an insulating housing with an opening such that part of the switch connector contact retractably protrudes out of the housing through the opening.

3. A power supply unit according to claim 2, wherein the switch contact and the connector contacts are disposed side by side in the housing.

4. A power supply unit according to claim 2, wherein the connector contacts have the same shape.

5. A power supply unit according to claim 2, wherein the insulating housing is retained in the holder.

6. A power supply unit according to claim 5, wherein the insulating housing is planar with a surface of the holder such that does not protrude into the hollow portion.

7. A power supply unit according to claim 2, wherein the switch connector contact is disposed in an opposite side of the holder as the remaining connector contacts.

8. A power supply unit according to claim 7, wherein the switch connector contact and the remaining connector contacts are disposed in the holder at different distances from an opening of the hollow portion.

9. A power supply unit according to claim 8, wherein the switch connector contact is disposed closer to an opening of the hollow portion than the remaining connector contacts.

10. A power supply unit according to claim 8, wherein the part of the switch connector contact that protrudes into the hollow portion is disposed closer to an opening of the hollow portion than the parts of the remaining connector contacts that protrude into the hollow portion.

11. A power supply unit comprising:

a holder with a hollow portion;

resilient parts that detect that a battery pack, which has electrode terminals, in the hollow portion is almost removed from the hollow portion and that switch to a backup power source before the battery pack is completely removed; and resilient pieces positioned correspondingly to the electrode terminals of the battery pack, wherein the resilient pieces are disposed in a different portion of the holder as the resilient parts, and wherein at least one of the resilient parts comprise a switch connector contact and a switch contact, the switch contact moving in coordination with the switch connector contact such that the switch connector contact and the switch contact are in contact when the switch connector contact protrudes into the hollow portion by at least a predetermined distance and are otherwise disengaged from each other.

12. A power supply unit according to claim 11, wherein the resilient pieces are disposed closer to an opening of the hollow portion than the resilient parts.

13. A power supply unit according to claim 11, wherein the resilient parts have different shapes and are disposed adjacent to each other.

14. A power supply unit according to claim 13, wherein the resilient pieces are disposed side by side and have the same shape.

* * * * *